US011939151B1

(12) United States Patent
Underwood et al.

(10) Patent No.: US 11,939,151 B1
(45) Date of Patent: Mar. 26, 2024

(54) DUNNAGE ASSEMBLY

(71) Applicant: The United States of America as Represented by the Secretary of the Navy, Indian Head, MD (US)

(72) Inventors: Timothy D. Underwood, Ellicott City, MD (US); Andrew S. Coombs, LaPlata, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 526 days.

(21) Appl. No.: 16/873,956

(22) Filed: Aug. 27, 2020

(51) Int. Cl.
*B65D 90/00* (2006.01)

(52) U.S. Cl.
CPC .... *B65D 90/004* (2013.01); *B65D 2590/0058* (2013.01)

(58) Field of Classification Search
CPC ..... B65D 90/004; B65D 90/0073; B65D 2590/0058; B65D 2590/0041; B65D 81/02; B65D 81/113; B65D 85/68; B65D 2585/687; F42B 39/00; F42B 39/28; F42B 39/14; F42B 39/22; F41F 3/042
USPC ..... 206/3
See application file for complete search history.

(56) References Cited

U.S. PATENT DOCUMENTS 4,037,536 A 7/1977 Griffith
4,423,683 A 1/1984 Telmo
6,357,582 B1 3/2002 Fischer
6,827,206 B2 * 12/2004 Brase ..... F42B 39/00 206/371
7,121,401 B1 * 10/2006 Sinha ..... F42B 39/02 206/315.11
7,308,981 B1 * 12/2007 Noel Du Payrat ..... F42B 39/00 206/317
7,422,102 B1 * 9/2008 Lam ..... F41F 3/042 206/488
9,329,010 B1 5/2016 Moy et al.
9,841,256 B2 12/2017 Teetzel et al.
9,874,427 B2 1/2018 Karlsson et al.
10,113,845 B1 * 10/2018 Segeren ..... C06B 21/0008
10,386,167 B2 * 8/2019 Noble ..... B65D 45/32
11,148,867 B1 * 10/2021 Boyd ..... B65D 81/113
2002/0134693 A1 9/2002 Boutet
2003/0097951 A1 * 5/2003 Kaiserman ..... F41F 3/00 102/374
2010/0236945 A1 9/2010 Johnson

* cited by examiner

*Primary Examiner* — Javier A Pagan
(74) *Attorney, Agent, or Firm* — Fredric J Zimmerman

(57) ABSTRACT

A dunnage assembly has a plurality of dunnage sections removably attached to each other and includes a forwardmost dunnage section and an aftmost dunnage section. The forwardmost dunnage section has the longest length and the aftmost dunnage section has the shortest length. Each dunnage section has a plurality of tubes and a plurality of tube collars that support the tubes such that the tubes are substantially parallel to each other. Each tube of each dunnage section has an interior region sized to receive a longitudinally extending item and is substantially coaxially aligned with a tube of an adjacent dunnage section. Each tube collar has a plurality of thru-holes therein where each thru-hole is sized to receive a portion of a tube. Each dunnage section includes a tube collar removably attached to a tube collar of an adjacent dunnage section.

26 Claims, 7 Drawing Sheets

DUNNAGE ASSEMBLY

STATEMENT OF GOVERNMENT INTEREST

The invention described herein may be manufactured and used by or for the government of the United States of America for governmental purposes without the payment of any royalties thereon or therefor.

TECHNICAL FIELD

Embodiments of a dunnage assembly are disclosed herein.

BACKGROUND

Rockets are typically manufactured at facilities that are remote from where the rockets are actually deployed and used. Therefore, it is necessary to ship the rocket to the location where the rocket will be deployed. The rocket is typically loaded into a dunnage assembly that is positioned within the interior of a shipping container. One commonly used rocket is the 2.75" diameter rocket known as the All-Up-Round (AUR) rocket which is shown in FIG. 1: Rocket 20 comprises warhead section 22, fuze section 23, a guidance section 24 and motor section 26. Motor section 26 includes nozzle 27. Rocket 20 further includes a plurality of fins 28. Fins 28 are known as "wrap-around fins". Motor section 26 contains propellant that is used to deliver rocket 20 from the launch point to the target. Guidance section 24 typically includes electronics to assist in guiding rocket 20. Typically, a plurality of rockets 20 are loaded into a rocket launcher that launches all rockets simultaneously. FIG. 2 shows a perspective view of a prior art dunnage assembly 30 that is configured to hold a plurality of rockets 20. Dunnage assembly 30 is configured to be inserted into the interior of a shipping container (not shown). The shipping container typically has an open aft end, a closed forward end and a cover that is configured to be removably attached to the open aft end so as to prevent dunnage assembly 30 from sliding out of the shipping container. Dunnage assembly 30 comprises a plurality of tubes 32 that are held together by collars 34. Typically, there are four tubes 32. Each tube 32 is configured to receive a corresponding rocket 20. Each collar 34 has a plurality of openings wherein each opening receives a corresponding tube 32. In order to facilitate insertion of each rocket 20 into a corresponding tube 32, fins 28 are typically taped down so that fins 28 will generally conform to the cylindrical profile of rocket 20. Once dunnage assembly 30 is inserted into the shipping container, rockets 20 are then inserted into the corresponding tubes 32. After rockets 20 are inserted into dunnage assembly 30, the shipping container cover (not shown) is attached to the open aft end of the shipping container.

Since rockets come in a variety of shapes, sizes and lengths, different size dunnage assemblies must be available in order to ship the various sized rockets. However, rockets having different lengths cannot be shipped in the same container because each rocket would have to have its own particular dunnage assembly and there would be no room within the shipping container for multiple dunnage assemblies. Furthermore, a unique dunnage assembly for holding a rocket having a particular length typically requires a unique shipping container specifically tailored to receive the unique dunnage assembly. Consequently, the manufacture or purchase of differently configured dunnage assemblies and corresponding shipping containers results in higher shipping costs. Additionally, storing large numbers of differently configured dunnage assemblies and corresponding shipping containers consumes significant amounts of warehouse space and complicates inventory management.

What is needed a dunnage assembly that eliminates the aforementioned problems and disadvantages associated with conventional dunnage assemblies.

SUMMARY

This summary is provided to introduce a selection of concepts in a simplified form that are further described below in the detailed description. This summary is not intended to identify key features or essential features of the claimed subject matter, nor is it intended to be used in isolation as an aid in determining the scope of the claimed subject matter.

Disclosed herein are exemplary embodiments of a dunnage assembly. The dunnage assembly is configured to be used with a shipping container. In some embodiments, the dunnage assembly includes a plurality of dunnage sections that are removably attached to each other and include a forwardmost dunnage section and an aftmost dunnage section. The forwardmost dunnage section has the longest length and the aftmost dunnage section has the shortest length. Each dunnage section includes a plurality of tubes and a plurality of tube collars that support the tubes such that the tubes are substantially parallel to each other. Each tube collar has a plurality of thru-holes therein wherein each thru-hole is sized to receive a portion of a tube. Each tube has an interior region sized for receiving a longitudinally extending item and is substantially coaxially aligned with a tube of an adjacent dunnage section.

In an embodiment, the interior region of each tube is sized for receiving a rocket and the forwardmost portion of the forwardmost dunnage section includes a rocket fuze support collar to support the fuze portions of the rockets that are disposed within the tubes. In such an embodiment, the dunnage assembly includes an insert member that is configured to be removably attached to the aftmost tube collar to protect the nozzle sections of the rockets.

Although the dunnage assembly disclosed herein is described in terms of the dunnage assembly being used to hold rockets, it is to be understood that the dunnage assembly may be used to hold and transport other fragile, longitudinally extending objects or components.

DETAILED DESCRIPTION

As used herein, the terms "comprise", "comprising", "comprises", "includes", "including", "has", "having" or any other variation thereof, are intended to cover a non-exclusive inclusion. For example, a process, method, article or apparatus that comprises a list of elements is not necessarily limited to only those elements, but may include other elements not expressly listed or inherent to such process, method, article or apparatus.

As used herein, terms such as "vertical", "horizontal", "top", "bottom", "upper", "lower", "middle", "above", "below" and the like are used for convenience in identifying relative locations of various components and surfaces relative to one another in reference to the drawings and that the dunnage assembly disclosed herein may be installed and used in substantially any orientation so that these terms are not intended to be limiting in any way.

Figure 3:
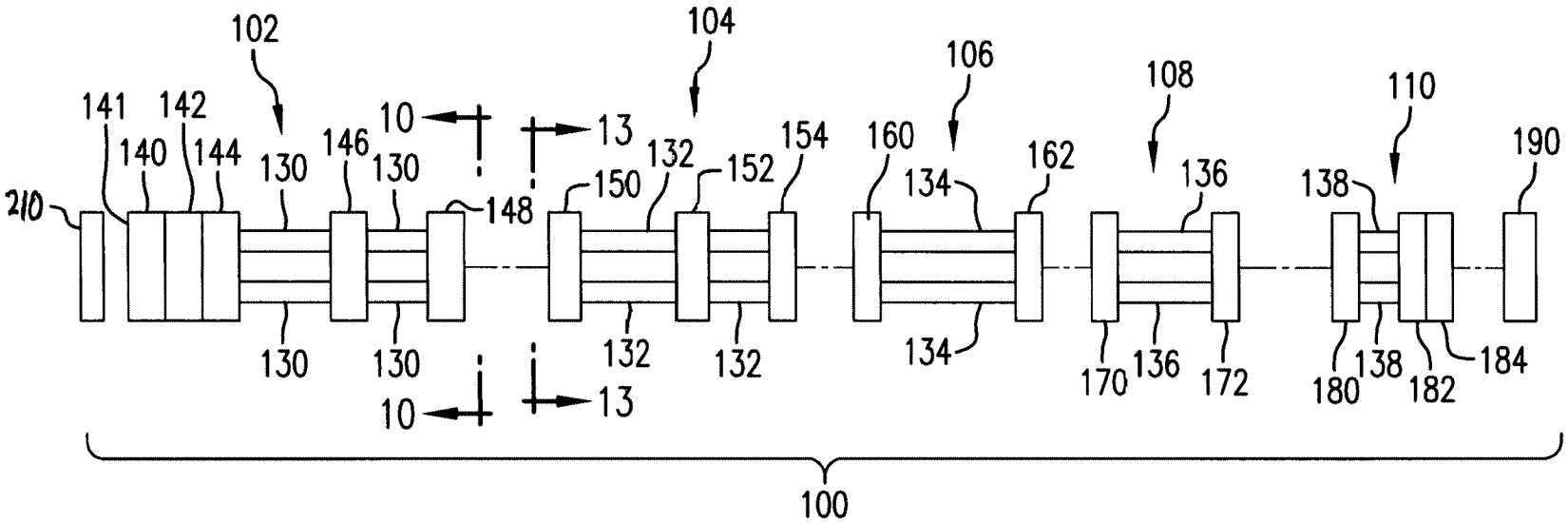
FIG. 3 is an exploded view of a dunnage assembly in accordance with an exemplary embodiment, wherein the dunnage assembly is arranged in a first configuration.
Figure 4:
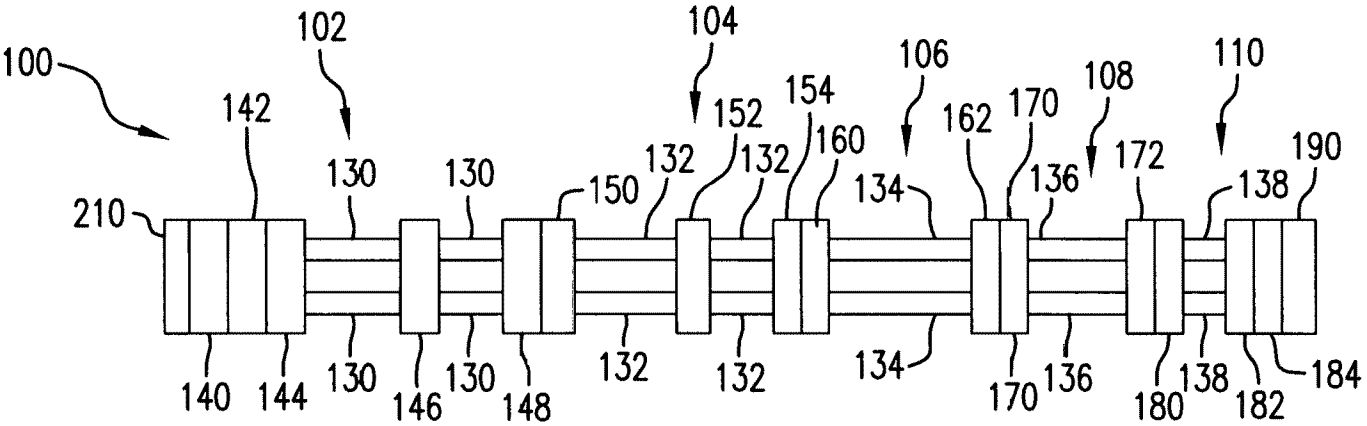
FIG. 4 is a side view of the dunnage assembly shown in FIG. 3 completely assembled.
Figure 5:
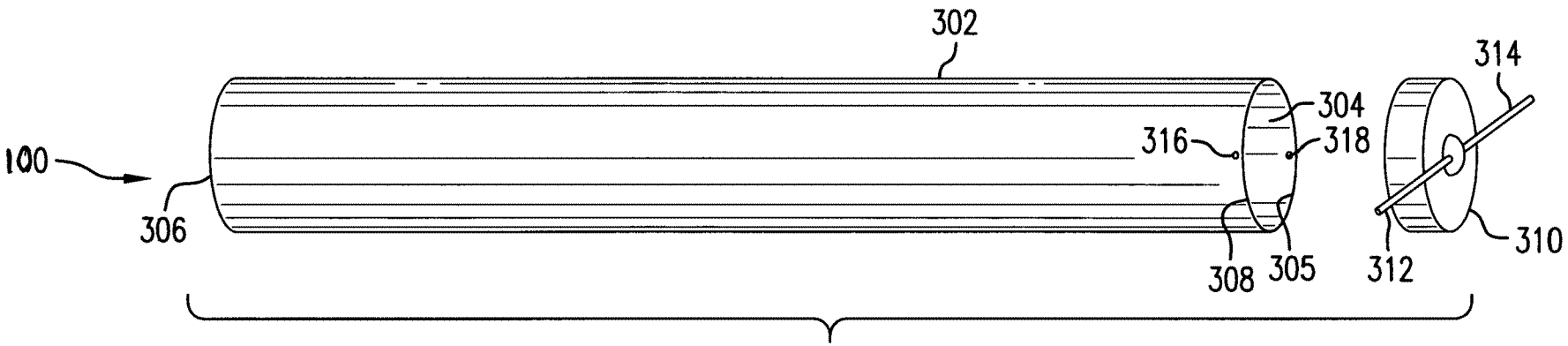
FIG. 5 is a side view of a shipping container configured to receive the dunnage assembly of FIG. 4.

Referring to FIGS. 3 and 4, there is shown an exploded view of dunnage assembly 100 in accordance with an exemplary embodiment. Dunnage assembly 100 includes a plurality dunnage sections 102, 104, 106, 108 and 110 that are joined together prior to dunnage assembly 100 being inserted into shipping container 300 (see FIG. 5). Dunnage section 102 is the forwardmost dunnage section and dunnage section 110 is the aftmost dunnage section. Referring to FIG. 5, shipping container 300 may be any suitable commercially available shipping container. Shipping container 300 includes container body 302 which has interior region 304 and interior surface 305 that extends about interior region 304. Interior region 304 is sized for receiving dunnage assembly 100. Container body 302 has closed forward end 306 and open aft end 308. Shipping container 300 includes cover 310 that is configured to be removably attached to container body 302 so as to close off open aft end 308. In some versions of shipping container 300, the cover 310 includes depressible protruding members 312 and 314 that can be pressed inward in order to fit cover 310 into open aft end 308. The cover 310 is adjusted so that protruding members 312 and 314 enter openings 316 and 318, respectively, in container body 302. The depressible protruding members 312 and 314 are spring biased by compression springs (not shown). However, it is understood that shipping container 300 may be configured to employ any one of a variety of suitable cover devices that allow a cover to be removably attached to open aft end 308.

Figure 8:
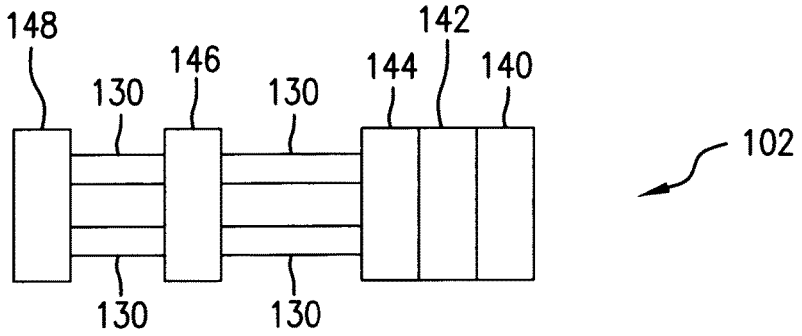
FIG. 8 is a side view of the opposite side of the forwardmost dunnage section shown in FIG. 3.

Referring to FIGS. 3 and 4, each dunnage section 102, 104, 106, 108 and 110 includes a plurality of tubes that are held together by a plurality of tube collars. In an exemplary embodiment, each dunnage section 102, 104, 106, 108 and 110 has four tubes. Each tube is configured so that its inner diameter allows the insertion therethrough of the rocket or other object but yet prevents the rocket from any rolling, rocking or other movement when positioned within the tube. For example, each tube may be internally sized to receive a commonly used military rocket known as the All-Up-Round (AUR) rocket, which has an outer diameter of about 2.75 inches. In an exemplary embodiment, the four tubes are substantially parallel to one another. For example, dunnage section 102 comprises tubes 130, rocket fuze support collar 140 and tube collars 142, 144, 146 and 148. FIG. 8 is provided to show tubes 130 that are on the opposite side of dunnage section 102. Tubes 130 are inserted into corresponding thru-holes in tube collars 142, 144, 146 and 148. Similarly, dunnage section 104 includes tubes 132 and tube collars 150, 152 and 154. Tubes 132 are inserted into corresponding thru-holes in tube collars 150, 152 and 154. Dunnage section 106 includes tube sections 134 and tube collars 160 and 162. Tubes 134 are inserted into corresponding thru-holes in tube collars 160 and 162. Dunnage section 108 comprises tubes 136 and tube collars 170 and 172. Tubes 136 are inserted into corresponding thru-holes in tube collars 170 and 172. Dunnage section 110 comprises tubes 138 and tube collars 180, 182 and 184. Tubes 138 are inserted into corresponding thru-holes in tube collars 180, 182 and 184.

Figure 11:
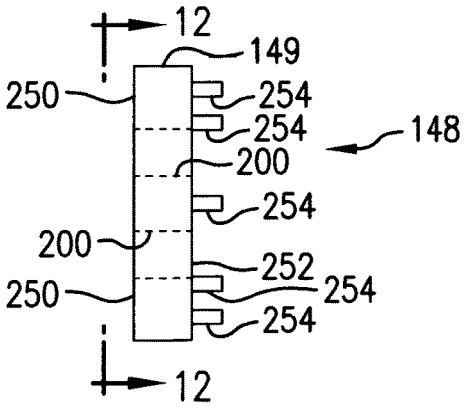
FIG. 11 is a side elevational view of the tube collar shown in FIG. 10.
Figure 12:
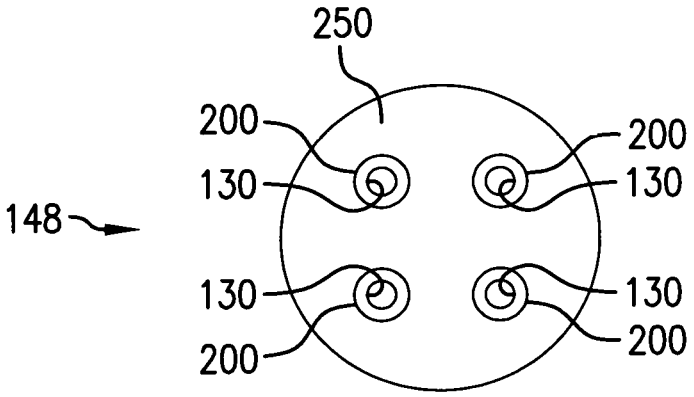
FIG. 12 is a view taken along line 12-12 in FIG. 11.

Each tube collar has a substantially circular shape, a circumferentially extending outer surface and a predetermined diameter that results in the circumferentially extending outer surface contacting interior surface 305 of container body 302. For example, and referring to FIGS. 4 and 11, tube collar 148 has circumferentially extending outer surface 149 that contacts interior surface 305 of container body 302 when dunnage assembly 100 is inserted into interior region 304 of container body 300.

Although dunnage section 102 is shown and described as having four tube collars 142, 144, 146 and 148, dunnage section 102 may have more than or less than four tube collars in other embodiments. Similarly, although dunnage sections 104 and 110 are shown and described to have three tube collars, dunnage sections 104 and 110 may have more than or less than three tube collars in other embodiments. Similarly, although dunnage sections 106 and 108 are shown and described as having two tube collars, dunnage sections 106 and 108 may have more than two tube collars in other embodiments. Additional tube collars interposed between the ends of a dunnage section facilitate centering of the tubes within interior region 304 of container body 302 thereby ensuring the maximum average cushioning. As more tube collars are added, the load spreads across the entire dunnage assembly 100.

As shown in FIG. 3, each dunnage section 102, 104, 106, 108 and 110 has a different length. In an exemplary embodiment, dunnage section 102 is longer than dunnage section 104 which is longer than dunnage section 106. Dunnage section 106 is longer than dunnage section 108 and dunnage section 108 is longer than dunnage section 110. The different lengths of the dunnage sections allow rockets and/or rocket sections of various lengths to be held by particular dunnage sections. This feature of dunnage assembly 100 is described in detail in the ensuing description.

Figure 1:
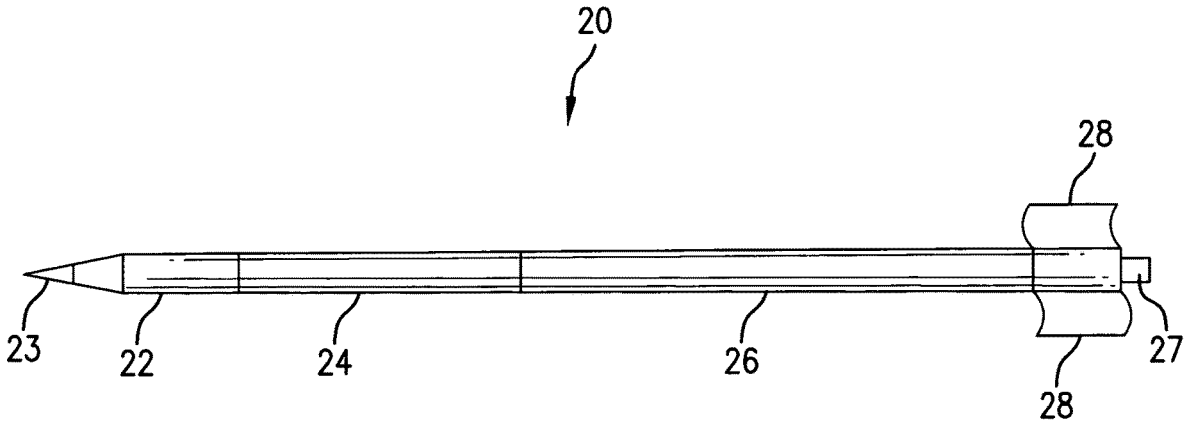
FIG. 1 is a side view of a rocket.
Figure 2:
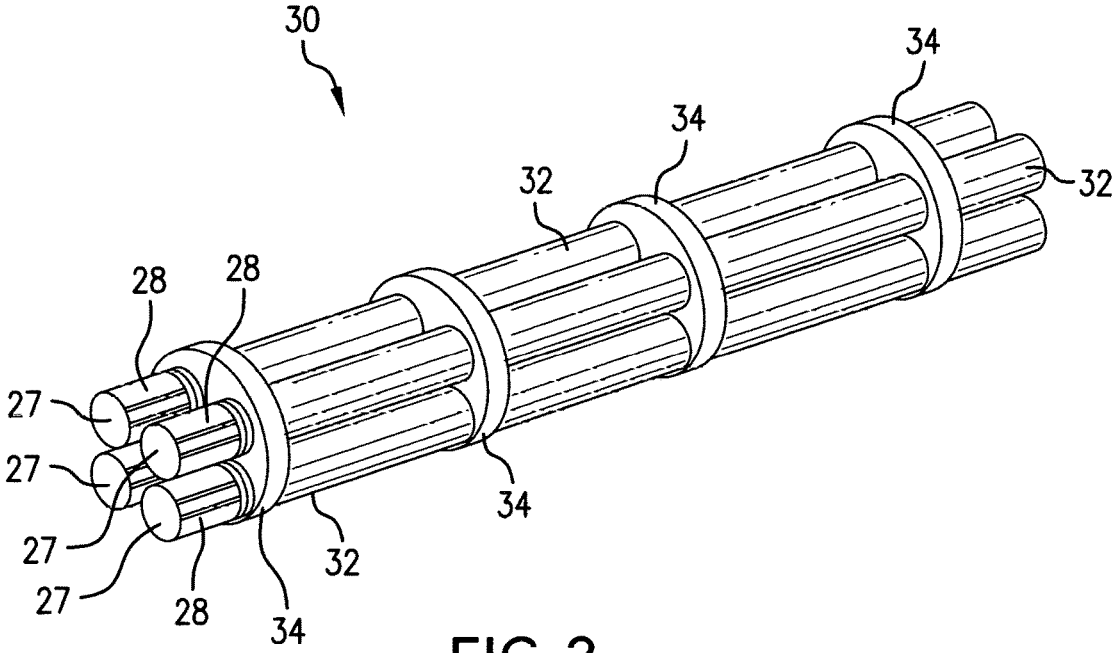
FIG. 2 (PRIOR ART)
FIG. 2 is a perspective view of a prior art dunnage assembly holding a plurality of rockets.

Referring to FIGS. 3, 4 and 14-16, dunnage assembly 100 further includes movable insert member 190 that is configured to receive the aft ends of the rockets. The aft end of each rocket 20 has nozzles 27 and wrap-around fins 28 (see FIG. 1). In an exemplary embodiment, insert member 190 comprises a solid circular insert and has a diameter that is substantially the same as the diameter of the tube collars. Insert member 190 includes interior side 192, exterior side 194 and a plurality of cut-out areas 195. Each cut-out area 195 is sized to receive an aft end of a rocket 20. The wrap-around fins 28 of each rocket 20 are first taped down. Insert member 190 is maneuvered so that the aft end of rocket 20 having the taped wrap-around fins 28 is inserted into a corresponding cut-out area 195. The cut-out areas 195 are configured so that each aft end of a rocket 20 frictionally fits into the cut-out area 195. Insert member 190 includes circumferentially extending surface 196 that contacts interior surface 305 of container body 302. Insert member 190 may be interposed between any pair of adjacent dunnage sections. The purpose of this feature is described in the ensuing description. In an exemplary embodiment, insert member 190 has holes or cavities 197 in interior side 192 and protrusions 198 extending from exterior side 194. The purposes of holes 197 and protrusions 198 are discussed in the ensuing description.

Figure 9:
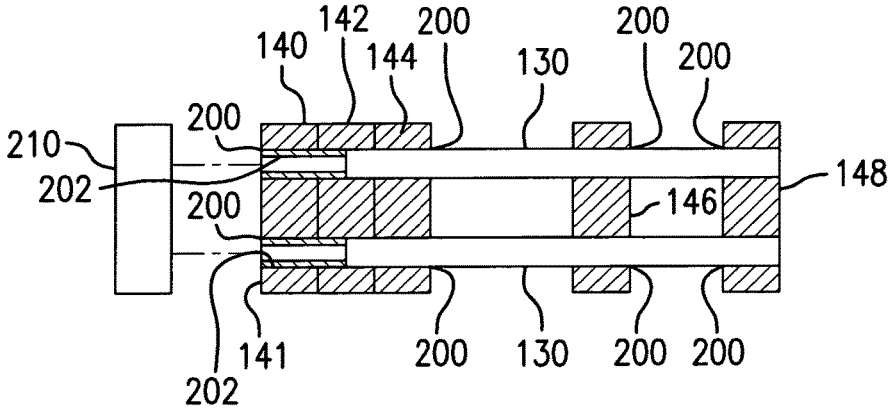
FIG. 9 is a side view, in cross-section, of the forwardmost dunnage section.
Figure 10:
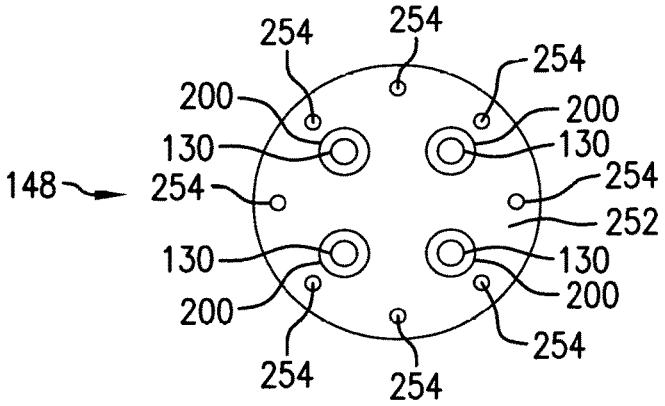
FIG. 10 is a view of a tube collar taken along line 10-10 in FIG. 3.

As shown in FIGS. 9 and 10, tubes 130 of dunnage section 102 are inserted through corresponding thru-holes 200 in tube collars 142, 144, 146 and 148. In an exemplary embodiment, tubes 130 do not extend into thru-holes 200 in rocket fuze support collar 140 and only partially extend into thru-holes 200 in tube collar 142. Rocket fuze support collar 140 supports and protects the fuze of the rocket. Rocket fuze support collar 140 includes four cylindrical members 202, wherein each cylindrical member 202 is positioned within a corresponding thru-hole 200 in rocket fuze support collar 140. Each cylindrical member 202 extends partially into thru-holes 200 in tube collar 142 (see FIG. 9) and abuts the end of a corresponding tube 130. Each cylindrical member 202 is substantially coaxially aligned with the adjacent tube 130 and has a length that is significantly less than the length of each tube 130. Although each cylindrical member 202 has an outer diameter that is substantially the same as the outer diameter of the adjacent tube 130, each cylindrical member 202 has an inner diameter that less than the inner diameter of the adjacent tube 130. Each cylindrical member 202 is sized to receive the fuze portion of a rocket. As shown in FIGS. 3, 4 and 9, dunnage assembly 100 includes pad member 210 that is attached to exterior side 141 of rocket fuze support collar 140 so as to cover the openings to cylindrical members 202 and protect the fuze portion of each rocket. Any suitable method or technique may be used to attach pad member 210 to exterior side 141 of rocket fuze support collar 140. In an exemplary embodiment, pad member 210 is adhered to exterior side 141 with an adhesive. When dunnage assembly 100 is completely inserted into interior region 304 of container body 302, pad member 210 abuts closed forward end 306 of container 300.

Dunnage sections 102, 104, 106, 108 and 110 and insert 190 are configured to be removably attached together so as to form an assembled dunnage assembly 100 as shown in FIG. 4. Dunnage section 102 is removably attached to dunnage section 104 by removably attaching tube collar 148 to tube collar 150. Dunnage section 104 is removably attached to dunnage section 106 by removably attaching tube collar 154 to tube collar 160. Dunnage section 106 is removably attached to dunnage section 108 by removably attaching tube collar 162 to tube collar 170. Dunnage section 108 is removably attached to dunnage section 110 by removably attaching tube collar 172 to tube collar 180. Insert member 190 may be removably attached to tube collar 184, or insert member 190 may be interposed between and removably attached to the tube collars of any pair of adjacent dunnage sections. For example, insert member 190 may be interposed between and removably attached to tube collars 148 and 150. In another example, insert 190 may be interposed between and removably attached to tube collars 154 and 160. In another example, insert 190 may be interposed between and removably attached to tube collars 162 and 170. In another example, insert 190 may be interposed between and removably attached to tube collars 172 and 180. Any suitable method, technique, components or devices may be used to removably attached the dunnage sections together. An example of a suitable technique for removably attaching the dunnage sections together is discussed in the ensuing description.

Figure 13:
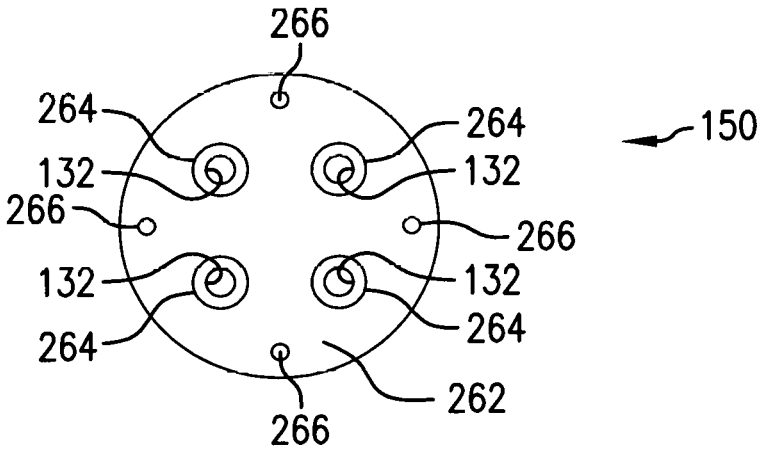
FIG. 13 is a view taken along line 13-13 in FIG. 3.
Figure 14:
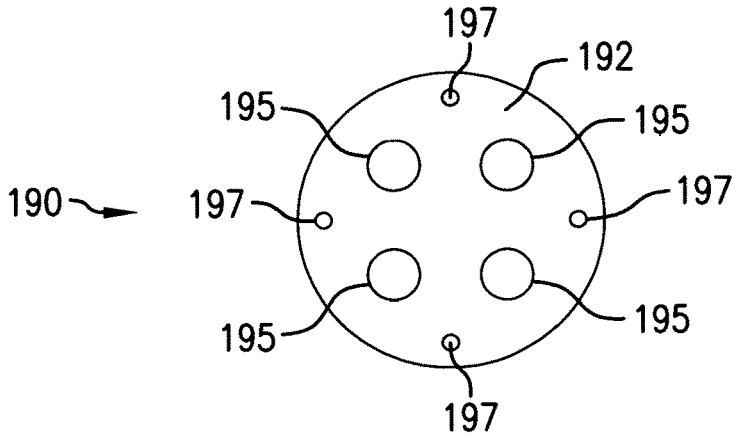
FIG. 14 is an elevational view of an interior side of an insert member shown in FIG. 3.
Figure 15:
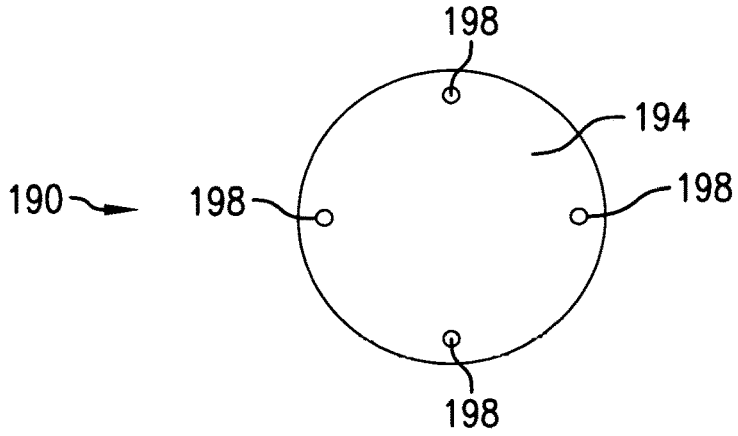
FIG. 15 is an elevational view of an exterior side of the insert member.
Figure 16:
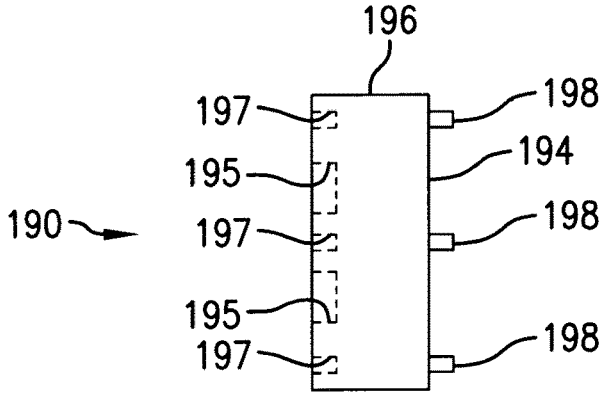
FIG. 16 is a side elevational view of the insert member.

FIGS. 10-13 show an exemplary embodiment of one technique for removably attaching the tube collars together. In order to facilitate understanding of this exemplary embodiment, reference is made to adjacent tube collars 148 and 150 shown in FIG. 4. Tube collar 148 includes interior side 250 and exterior side 252. Exterior side 252 faces tube collar 150. Tube collar 148 includes protrusions or tabs 254 that extend from exterior side 252. In an exemplary embodiment, protrusions 254 are substantially square-shaped. In other embodiments, protrusions 254 are cylindrically shaped. Protrusions 254 are equidistantly spaced. In an exemplary embodiment, there are eight protrusions 254 that are angularly spaced apart by about 45°. The purpose of protrusions 254 is explained in conjunction with the description of tube collar 150. Tube collar 150 includes exterior side 262 which faces exterior side 252 of tube collar 148 (see FIG. 13). Tube collar 150 has a plurality of thru-holes or openings 264 that are sized to receive tubes 132 and therefore provide the same function as openings 200 in tube collar 148. As shown in FIG. 13, tube collar 150 further includes a plurality of holes or cavities 266 in exterior side 262. Each hole 266 is sized for frictionally receiving a corresponding protrusion 254 of tube collar 148. Holes 266 are equidistantly spaced about exterior side 262. In an exemplary embodiment, there are four holes 266 that are spaced about 90° apart. In order to removably attach dunnage section 102 to dunnage section 104, the users may maneuver dunnage section 102 so that protrusions 254 of tube collar 148 are inserted into corresponding holes 266 in exterior side 262 of tube collar 150. In order to separate dunnage section 102 from dunnage section 104, the users may hold dunnage section 102 still while dunnage section 104 is pulled away from dunnage section 102 so that protrusions 254 are withdrawn from holes 266. The other tube collars in dunnage assembly 100 also have the same protrusions and corresponding holes. For example, tube collar 154 is configured to have protrusions (not shown) that are configured to be frictionally inserted into corresponding holes (not shown) in tube collar 160. Tube collar 162 is configured to have protrusions (not shown) that are configured to be frictionally inserted into corresponding holes (not shown) in tube collar 170. Similarly, tube collar 172 is configured to have protrusions (not shown) that are configured to be frictionally inserted into corresponding holes (not shown) in tube collar 180. Tube collar 184 is configured to have protrusions (not shown) that are configured to be frictionally inserted into corresponding holes 197 in insert member 190.

In other embodiments, tube collars 148, 154, 162 and 172 are configured to have the holes and tube collars 150, 160, 170 and 180 are configured to have the corresponding protrusions. In some embodiments, Velcro® strips are used on the tube collars to attach, removably, or join the dunnage sections together. In other exemplary embodiments, magnetic strips are used on tube collars to attach, removably, or join the dunnage sections together.

Dunnage assembly 100 is configured to hold a rocket having a predetermined maximum length. When a rocket having the maximum length is inserted into dunnage assembly 100, the rocket nozzles extend from tube collar 184. Insert member 190 is interposed between tube collar 184 and cover 310 of shipping container 300 (see FIGS. 4 and 5) such that the nozzles are positioned within cut-out areas 195 and the protrusions (not shown) of tube collar 184 are frictionally inserted into corresponding holes 197 in insert member 190. The insert member 190 becomes centered and is able to provide longitudinal support once the rocket nozzles are positioned within cut-out areas 195.

Figure 6:
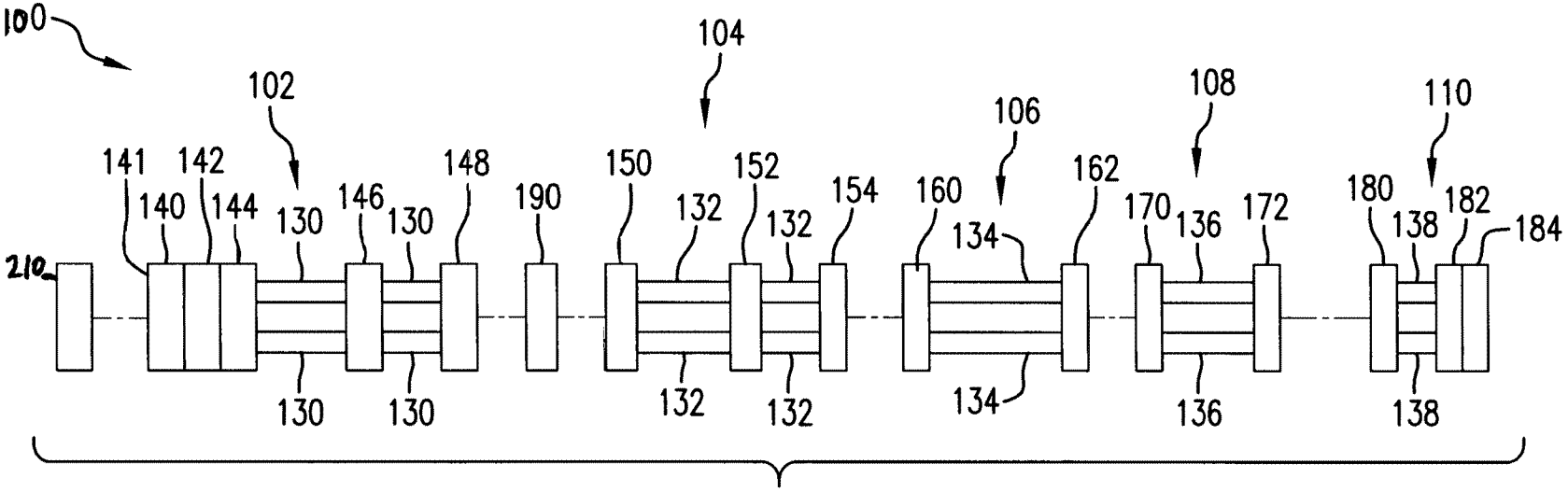
FIG. 6 is another exploded view of the dunnage assembly of FIG. 4, wherein the dunnage assembly is arranged in a second configuration.

Referring to FIG. 6, there is shown an exploded view of dunnage assembly 100 arranged in a configuration that allows the dunnage assembly 100 to securely hold a relatively short rocket or rocket section. The length of this short rocket or rocket section corresponds to the length of dunnage section 102. The short rocket or rockets are inserted into tubes 130 of dunnage section 102. All fuzes of the rockets are positioned in cylindrical members 202 in fuze support collar 140. Insert member 190 is interposed between dunnage sections 102 and 104 and protrusions 254 of tube collar 148 are frictionally inserted into holes 197 in interior side 192 of insert member 190. The rocket nozzles protruding from tube collar 148 are positioned within cut-out areas 195 of insert member 190. Protrusions 198 on exterior side 194 of insert member 190 are inserted into corresponding holes 266 in tube collar 150. In addition to covering the rocket nozzles, insert member 190 provides a centering function as well which centers tubes 130 when dunnage assembly 100 is positioned within container 300. In this configuration, dunnage sections 104, 106, 108 and 110 remain empty, but the entire dunnage assembly 100, including the empty dunnage sections, is inserted into interior region 304 of container body 302. The empty dunnage sections provide longitudinal support. This longitudinal support may be significantly enhanced by rotating the empty dunnage sections by about 45°. As described in the foregoing description, the protrusions on tube collars 148, 154, 162, 172 and 184 are equidistantly spaced by about 45° and the corresponding holes in tube collars 150, 160, 170, and 180 are equidistantly spaced by about 90° thereby allowing empty dunnage sections 104, 106, 108 and 110 to be rotated 45° so that tubes 132, 134, 136 and 138 of the empty dunnage sections are out-of-line with the longitudinally extending axes of tubes 130 of dunnage section 102. In this configuration, dunnage section 104 is rotated 45° and maneuvered so that so that holes (not shown) in tube collar 150 are aligned with the protrusions 198 of insert member 190 that are 45° offset from center. The uses maneuver dunnage section 104 so that the offset protrusions 198 are frictionally inserted into the corresponding holes 266 of tube collar 150. If dunnage sections 104, 106, 108 and 110 are already attached together, then these four dunnage sections may be rotated as a single unit and then attached to insert member 190. In such a configuration, the rotated empty dunnage sections 104, 106, 108 and 110 provide additional longitudinal support to insert member 190.

Figure 7:
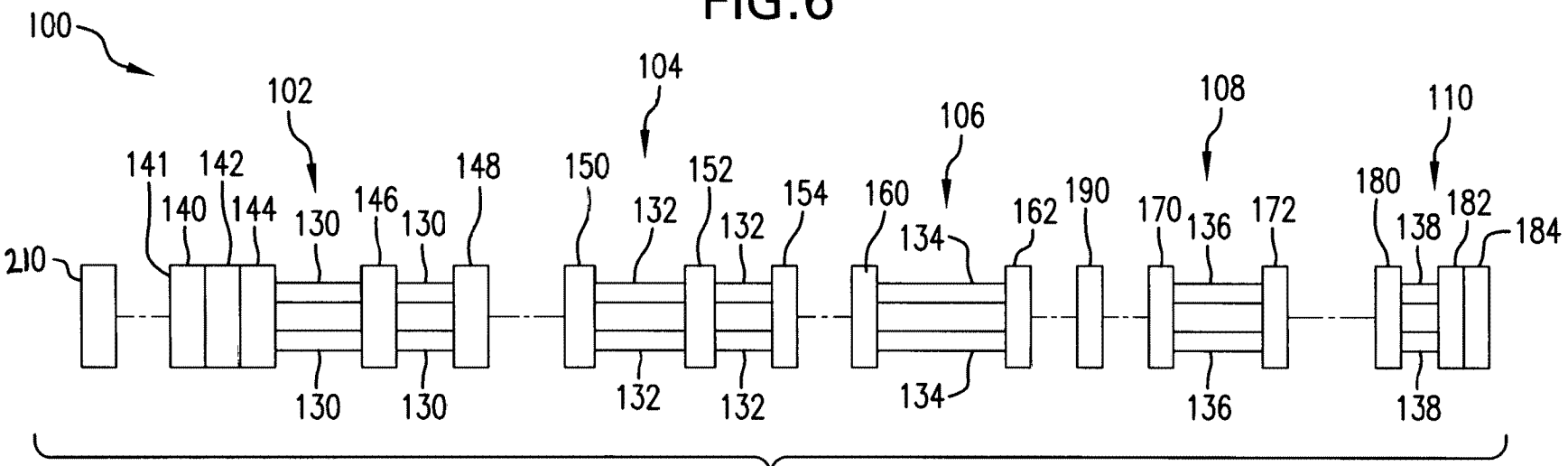
FIG. 7 is another exploded view of the dunnage assembly of FIG. 4, wherein the dunnage assembly is arranged in a third configuration.

Referring to FIG. 7, there is shown dunnage assembly 100 configured to hold a rocket or rockets of medium length. In an embodiment, a medium length corresponds to the combined length of dunnage sections 102, 104 and 106. In this configuration, insert member 190 is interposed between dunnage sections 106 and 108 and removably attached to tube collars 162 and 170. The rockets are positioned within dunnage sections 102, 104 and 106, the fuze sections of the rockets are positioned within cylindrical members 202 that are located within fuze support collar 140, and the nozzles of the rockets are positioned within cut-out areas 195 of insert member 190. The protrusions (not shown) of tube collar 162 are frictionally inserted into corresponding holes 197 in insert member 190 and protrusions 198 of insert member 190 are frictionally inserted into corresponding holes (not shown) in tube collar 170. In this configuration, dunnage section 110 is unused and may be rotated 45° and attached to tube collar 172 so as to provide longitudinal support as explained in the foregoing description.

In some embodiments, each dunnage section 102, 104, 106, 108 and 110 may have a different color for easy identification and used in conjunction with a color-code chart that describes the particular rocket lengths and the colors that are associated with the particular rocket length. Color-coding the dunnage sections in this manner would assist personnel in loading rockets or rocket sections of various lengths into the appropriate dunnage sections. For example, a particular rocket length may correspond to the color red on the color-code chart and the color red is the color of dunnage section 102. This means that the entire rocket could be encapsulated by just dunnage section 102, insert member 190 and pad member 210. In another example, a particular rocket length may correspond to both colors red and green on the color-code chart and the colors red and green correspond to both dunnage sections 102 and 104. This means the entire rocket could be encapsulated by dunnage sections 102 and 104, insert member 190 and pad member 210.

Dunnage assembly 100 may be fabricated from any suitable materials. For example, the tubes, tube collars, fuze support collar 140, insert member 190, cylindrical members 202 and pad member 210 may be fabricated from at least one of acrylonitrile butadiene styrene (ABS), rubber, resin, neoprene, plastic, polystyrene, polyvinylchloride (PVC), polycarbonate, sugarcane-based polyethylene and composites. Container 300 may be fabricated from at least one of metals, wood or any of the aforementioned materials that may be used to fabricate the tubes and tube collars.

In some embodiments, one or more humidity indicators or sensors are positioned within interior region 304 of container body 302 to monitor humidity during shipping and storage.

Although the foregoing description is in terms of the dunnage assembly disclosed herein being used to hold and transport rockets, it is to be understood that the dunnage assembly may be used to hold and transport other types of longitudinally extending objects such as rods or tubular objects made of precious metals, composites or graphite, nuclear fuel rods for nuclear reactors or other fragile longitudinally extending objects.

The foregoing description of illustrated embodiments of the subject disclosure, including what is described in the Abstract, is not intended to be exhaustive or to limit the disclosed exemplary embodiments to the precise forms disclosed. While specific exemplary embodiments and examples are described herein for illustrative purposes, various modifications are possible that are considered within the scope of such embodiments and examples, as those skilled in the relevant art can recognize. In this regard, while the disclosed subject matter has been described in connection with various embodiments and corresponding Figures, where applicable, it is to be understood that other similar embodiments can be used or modifications and additions can be made to the described exemplary embodiments for performing the same, similar, alternative or substitute function of the disclosed subject matter without deviating therefrom. Therefore, the disclosed subject matter should not be limited to any single embodiment described herein, but rather should be construed in breadth and scope in accordance with the appended claims below.

What is claimed:

1. A dunnage assembly configured for use within a shipping container, comprising:

a plurality of dunnage sections being removably attached to each other, wherein each of the plurality of dunnage sections comprises a plurality of tubes and a plurality of tube collars that support the plurality of tubes such that the plurality of tubes are substantially parallel to each other, wherein each of the plurality tube collars includes a plurality of thru-holes therein, wherein each of the plurality of thru-holes is sized to receive a portion of said each of the plurality of tubes, and wherein said each of the plurality of tubes includes an interior region sized to receive a longitudinally extending item and being substantially coaxially aligned with a tube of an adjacent dunnage section.

2. The dunnage assembly according to claim 1, wherein each of the plurality of tube collars has a circumferentially extending outer surface to contact an interior surface of the shipping container when the dunnage assembly is positioned within the shipping container.

3. The dunnage assembly according to claim 1, wherein said each of the plurality of dunnage sections includes said each of the plurality of tube collars is removably attached to a tube collar of an adjacent dunnage section.

4. The dunnage assembly according to claim 1, wherein each of the plurality of dunnage section includes a tube collar having a plurality of protrusions sized for frictional insertion into corresponding holes in a tube collar of an adjacent dunnage section.

5. The dunnage assembly according to claim 4, wherein the plurality of protrusions are equidistantly spaced apart and the corresponding holes are equidistantly spaced apart.

6. The dunnage assembly according to claim 4, wherein the plurality of protrusions are equidistantly spaced apart and the corresponding holes are equidistantly spaced apart, and wherein the plurality of the protrusions are spaced apart by about 45° and the corresponding holes are spaced apart by about 90°.

7. The dunnage assembly according to claim 1, wherein said each of the plurality of tubes includes a longitudinally extending axis and the dunnage assembly is configurable to a configuration, and wherein the plurality of dunnage sections include a first dunnage section removably attached to an adjacent second dunnage section and oriented such that the tubes of the first dunnage section are axially offset with respect to the longitudinally extending axes of the tubes of the adjacent second dunnage section.

8. The dunnage assembly according to claim 1, wherein each of the plurality of dunnage sections comprises at least two tube collars.

9. The dunnage assembly according to claim 1, wherein each of the plurality of dunnage sections has four tubes.

10. The dunnage assembly according to claim 1, wherein each of the plurality of dunnage sections has a different length where each of the plurality of the dunnage sections is arranged according to the length of each of the plurality of dunnage sections, and wherein a forwardmost dunnage section has a longest length and an aftmost dunnage section has a shortest length.

11. The dunnage assembly according to claim 1, wherein the dunnage assembly includes an aftmost dunnage section and a forwardmost dunnage section, wherein the aftmost dunnage section includes a first tube collar removably attached to a tube collar of an adjacent dunnage section and a second tube collar constitutes an aftmost tube collar of the dunnage assembly, wherein the dunnage assembly further comprises an insert member removably attached to the second tube collar, wherein the insert member comprises an interior side having a plurality of cut-out areas, and wherein each of the plurality of cut-out areas is aligned with a corresponding opening in the second tube collar such that each tube of aftmost dunnage section is aligned with a corresponding cut-out area.

12. The dunnage assembly according to claim 11, wherein the insert member is a circular shaped insert member.

13. The dunnage assembly according to claim 1, wherein the dunnage assembly has a forwardmost dunnage section and an aftmost dunnage section, and wherein the forwardmost dunnage section includes a first tube collar removably attached to a tube collar of an adjacent dunnage section, a fuze support collar that constitutes a forwardmost portion of the forwardmost dunnage section and a second tube collar removably attached to the fuze support collar and located between the fuze support collar and the first tube collar.

14. The dunnage assembly according to claim 13, wherein the fuze support collar has a plurality of thru-holes, wherein each of the plurality of thru-holes in the fuze support collar is substantially aligned with a corresponding thru-hole in the second tube collar, wherein each tube in the forwardmost dunnage section does not extend into the thru-holes of the fuze support collar, wherein the forwardmost dunnage section further includes a plurality of cylindrical members, and wherein each of the plurality of cylindrical members is positioned within a corresponding thru-hole in the fuze support collar and is substantially coaxially aligned with a corresponding tube of the forwardmost dunnage section.

15. The dunnage assembly according to claim 13, wherein the fuze support collar has a plurality of thru-holes, wherein each of the plurality of thru-holes in the fuze support collar is substantially aligned with a corresponding thru-hole in the second tube collar, wherein each tube in the forwardmost dunnage section does not extend into the thru-holes of the fuze support collar, wherein the forwardmost dunnage section further includes a plurality of cylindrical members, and wherein each of the plurality of cylindrical members is positioned within a corresponding thru-hole in the fuze support collar and is substantially coaxially aligned with a corresponding tube of the forwardmost dunnage section, wherein said each tube in the forwardmost dunnage section includes a first inner diameter and a first length, and wherein said each of the plurality of cylindrical members includes a second inner diameter that is less than the first inner diameter and a second length that is less than the first length.

16. The dunnage assembly according to claim 13, wherein the fuze support collar has a plurality of thru-holes, wherein each of the plurality of thru-holes in the fuze support collar is substantially aligned with a corresponding thru-hole in the second tube collar, wherein each tube in the forwardmost dunnage section does not extend into the thru-holes of the fuze support collar, wherein the forwardmost dunnage section further includes a plurality of cylindrical members, and wherein each of the plurality of cylindrical members is positioned within a corresponding thru-hole in the fuze support collar and is substantially coaxially aligned with a corresponding tube of the forwardmost dunnage section, wherein the fuze support collar includes an exterior side and an interior side that abuts the second tube collar, wherein the cylindrical members are accessible at the exterior side, and wherein the dunnage assembly further includes a pad member attached to the exterior side of the fuze support collar to cover the cylindrical members.

17. The dunnage assembly according to claim 13, wherein the dunnage assembly includes a forwardmost dunnage section and an aftmost dunnage section, wherein the forwardmost dunnage section further includes a plurality of cylindrical members, and wherein the plurality of tubes, the plurality of tube collars and the plurality of cylindrical members are fabricated from materials selected from at least one of acrylonitrile butadiene styrene (ABS), rubber, resin, neoprene, plastic, polystyrene, polyvinylchloride (PVC), polycarbonate, sugarcane-based polyethylene and composite.

18. A dunnage assembly for holding at least one rocket having a fuze portion and a nozzle portion, comprising:

a plurality of dunnage sections being removably attached to each other, wherein each of the plurality of dunnage sections includes a different length, wherein the plurality of dunnage sections are arranged according to a length of each of the plurality of dunnage sections, wherein the plurality of dunnage sections includes a forwardmost dunnage section with a longest length and an aftmost dunnage section with a shortest length, wherein said each of the plurality of the dunnage sections includes a plurality of tubes and a plurality of tube collars that support the plurality of tubes such that the plurality of tubes are substantially parallel to each other, wherein each of the plurality of tube collars includes a plurality of thru-holes therein, wherein each of the plurality of thru-holes is sized to receive a portion of a tube, wherein each tube of said plurality of tubes includes an interior region sized to receive a rocket and being substantially coaxially aligned with a tube of an adjacent dunnage section, wherein each of the plurality of dunnage sections includes a first tube collar and a second tube collar, and wherein the first tube collar is removably attached to the second tube collar of an adjacent dunnage section.

19. The dunnage assembly according to claim 18, wherein the forwardmost dunnage section includes a first tube collar that is removably attached to a tube collar of an adjacent dunnage section, a rocket fuze support collar that constitutes a forwardmost portion of the forwardmost dunnage section and a second tube collar that is located between the first tube collar and the rocket fuze support collar, wherein the rocket fuze support collar includes an interior side and an exterior side, and wherein the second tube collar is attached to the rocket fuze support collar and abuts the interior side.

20. The dunnage assembly according to claim 19, further comprising a plurality of cylindrical members, wherein said each of the plurality of cylindrical members is positioned within a corresponding thru-hole in the fuze support collar and is substantially coaxially aligned with a corresponding tube of the forwardmost dunnage section, and wherein the cylindrical members are accessible at the exterior side of the rocket fuze support collar; and a pad member being attached to the exterior side of the rocket fuze support collar for covering the cylindrical members and to protect the fuze portion of the rocket, wherein the fuze support collar includes a plurality of thru-holes therein, wherein said each of the plurality of thru-holes in the fuze support collar is substantially coaxially aligned with a corresponding thru-hole in the second tube collar, and wherein said each tube in the forwardmost dunnage section includes a first inner diameter and does not extend into the thru-holes of the fuze support collar, and wherein said each of the plurality of cylindrical members includes a second inner diameter that is less than the first inner diameter and is sized to receive the fuze portion of a rocket.

21. The dunnage assembly according to claim 18, wherein said each tube has a longitudinally extending axis and the dunnage assembly is configurable to a configuration, and wherein a first dunnage section is removably attached to an adjacent second dunnage section and oriented such that the tubes of the first dunnage section are axially offset with respect to the longitudinally extending axes of the tubes of the adjacent second dunnage section.

22. The dunnage assembly according to claim 18, wherein the aftmost dunnage section includes a first tube collar that is removably attached to a tube collar of an adjacent dunnage section and a second tube collar that constitutes an aftmost portion of the aftmost dunnage section, and wherein the second tube collar has an interior side and an exterior side.

23. The dunnage assembly according to claim 22, further comprising an insert member being removably attached to the exterior side of the second tube collar, wherein the insert member comprises an interior side having a plurality of cut-out areas, wherein each of the plurality of cut-out areas is aligned with a corresponding opening in the second tube collar such that said each tube of the aftmost dunnage section is aligned with a corresponding cut-out area, and wherein said each of the plurality of cut-out areas is sized to receive a nozzle portion of a rocket.

24. The dunnage assembly according to claim 22, wherein the second tube collar includes a diameter, and wherein the insert member is a circular shaped insert member with a first diameter that is substantially the same as the diameter of the second tube collar.

25. The dunnage assembly according to claim 18, wherein said each dunnage section includes a tube collar removably attached to a tube collar of an adjacent dunnage section.

26. The dunnage assembly according to claim 18, wherein said each dunnage section has a tube collar having a plurality of protrusions sized for frictional insertion into corresponding holes in a tube collar of an adjacent dunnage section.

* * * * *